US007182432B2

(12) United States Patent
Van Den Berg et al.

(10) Patent No.: US 7,182,432 B2
(45) Date of Patent: Feb. 27, 2007

(54) INKJET PRINTHEAD

(75) Inventors: Marcus J. Van Den Berg, SP Venlo (NL); Hans Reinten, BD Velden (NL)

(73) Assignee: OCE-Technologies B.V., Venlo (NL)

( * ) Notice: Subject to any disclaimer, the term of this patent is extended or adjusted under 35 U.S.C. 154(b) by 268 days.

(21) Appl. No.: 10/817,908

(22) Filed: Apr. 6, 2004

(65) Prior Publication Data

US 2004/0201644 A1 Oct. 14, 2004

(30) Foreign Application Priority Data

Apr. 8, 2003 (EP) ..... 03076047

(51) Int. Cl.
*B41J 2/135* (2006.01)
*B41J 2/045* (2006.01)

(52) U.S. Cl. ..... 347/46; 347/68

(58) Field of Classification Search ..... 347/46, 347/65, 88, 94, 68–72, 85
See application file for complete search history.

(56) References Cited

U.S. PATENT DOCUMENTS

| | | | |
|---|---|---|---|
| 4,383,264 | A * | 5/1983 | Lewis ..... 347/68 |
| 4,424,520 | A | 1/1984 | Matsuda et al. |
| 5,943,079 | A | 8/1999 | Yoshida |
| 6,394,589 | B1 | 5/2002 | Willus et al. |
| 6,431,689 | B1 | 8/2002 | Schippers |
| 2003/0063171 | A1 | 4/2003 | Otsuka et al. |

FOREIGN PATENT DOCUMENTS

| | | |
|---|---|---|
| EP | 0 726 151 A2 | 8/1996 |
| EP | 0 760 286 A1 | 3/1997 |
| EP | 1 022 140 A1 | 7/2000 |
| EP | 1 078 760 A2 | 2/2001 |
| EP | 1 266 761 A2 | 12/2002 |
| JP | 56089570 | 7/1981 |
| JP | 01005853 | 1/1989 |

* cited by examiner

*Primary Examiner*—Stephen Meier
*Assistant Examiner*—Geoffrey S. Mruk
(74) *Attorney, Agent, or Firm*—Birch, Stewart, Kolasch & Birch, LLP

(57) ABSTRACT

An inkjet printhead having a plurality of pressure chambers each of which is fluidly connected on the one hand, via an ink supply path, to a common ink reservoir and on the other hand to a nozzle, wherein an actuator is provided for each pressure chamber for pressurizing the ink contained therein so as to eject an ink droplet through the nozzle in accordance with a print signal, and an acoustic wave attenuator is arranged to control the acoustic reflection and transmission properties of the ink supply path.

5 Claims, 1 Drawing Sheet

INKJET PRINTHEAD

This non-provisional application claims priority under 35 U.S.C. § 119(a) on Patent Application No. 03076047.4 filed in Europe on Apr. 8, 2003, which is herein incorporated by reference.

BACKGROUND OF THE INVENTION

The present invention relates to an inkjet printhead having a plurality of pressure chambers each of which is fluidly connected on the one hand, via an ink supply path, to a common ink reservoir and on the other hand to a nozzle, wherein an actuator is provided for each pressure chamber for pressurizing the ink contained therein, so as to eject an ink droplet through the nozzle in response to a print signal.

EP-A-1 022 140 describes a drop-on-demand inkjet printhead of the type indicated above, wherein the nozzles are arranged in two parallel linear arrays, so that a plurality of pixel lines of an image can be printed simultaneously. The pressure chambers associated with the nozzles of both arrays are configured as elongated ink channels that are formed in opposite surfaces of a common substrate and extend in parallel to one another. The downstream ends of the ink channels each converge into an associated nozzle, whereas the upstream ends of the ink channels of both arrays are connected to the common ink reservoir through their respective ink supply paths. The actuators are formed by piezoelectric elements that are arranged along each ink channel. When an ink droplet is to be expelled from a specific nozzle, the associated actuator is energized such that the piezoelectric element will first contract, so that ink is sucked-in through the ink supply path, and the piezoelectric element will then expend again, so that the liquid ink contained in the ink channel is pressurized and an acoustic pressure wave will propagate towards the nozzle.

A problem encountered with printheads of this type is the occurrence of cross-talk among the various nozzles. A major reason for this cross-talk phenomenon is the propagation of acoustic waves in the solid material of the piezoelectric actuators and in the common substrate in which the ink channels are formed. As is known in the art, this kind of cross-talk can be suppressed, for example, by selecting an appropriate design for the substrate and the ink channels and by providing a suitable support structure for the piezoelectric actuators.

Another source of cross-talk may be the propagation of acoustic waves through the liquid ink in the ink supply system. In order to avoid cross-talk of this kind, EP-A-0 726 151 proposes a printhead in which the ink supply paths connecting the pressure chambers to the common ink reservoir comprise acoustically matched sets of inlet filters, inlet ports, and inlet channels, which are designed to avoid, through acoustic matching, the propagation of acoustic waves from the various pressure chambers into the ink reservoir. In the printhead described in this document, the ink reservoir is formed by a closed chamber which is bounded on one side by a compliant wall. The purpose of this compliant wall is to further minimize pressure fluctuations in the ink reservoir during the "start up" of the printhead, until a steady ink flow is established.

However, it has been found that the printed images obtained with an inkjet printer of the type described above may, under certain conditions, still show some undesired artifacts which degrade the image quality.

SUMMARY OF THE INVENTION

It is accordingly on object of the present invention to provide a multi-nozzle inkjet printhead which provides an improved image quality.

According to the present invention, this object is achieved by an inkjet printhead provided with an acoustic wave attenuator disposed to control the acoustic wave transmission and reflection properties of the ink supply path.

The inventors have found that the artifacts mentioned above can be traced back to a new type of cross-talk phenomenon which has not yet been addressed in the prior art and which can be explained as follows: Ideally, the ink supply path which connects the pressure chamber to the ink reservoir and hence to the other pressure chambers of the array(s) should behave like an open end of the pressure chamber, so that acoustic waves propagating towards the ink reservoir are reflected almost completely with phase inversion. Then, for example, when the piezoelectric actuator performs its suction stroke and a negative pressure wave propagates towards the ink reservoir, this pressure wave will be reflected and will return as a positive pressure wave propagating towards the nozzle. This positive pressure wave will then be boosted further when the actuator performs its compression stroke.

In a conventional printhead, the ink supply path is configured, i. e., acoustically matched, to fulfill this requirement. As a result, due to the practically complete reflection of the acoustic waves at the ink supply path, these waves should be prevented from propagating further into the ink reservoir and into the other pressure chambers. However, due to constructional constraints, the ink supply path can only have a limited cross-sectional area. In spite of this restricted cross-section, the ink supply path will act as an open end, as desired, when only a single actuator is energized. If, however, a plurality of neighboring actuators are energized simultaneously in accordance with the image information to be printed, then the restricted area where the ink supply paths of the various pressure chambers are jointly connected to the ink reservoir will form a bottleneck for the ink flowing into the pressure chambers. As a consequence, the ink supply path can no longer act as an ideal open end, and the acoustic waves propagating towards the ink reservoir will be only partially reflected, and a portion of the acoustic energy is transmitted into the ink reservoir and into the other pressure chambers which gives rise to cross-talk.

According to the present invention, the acoustic wave attenuator is arranged to control the reflection and transmission behavior of the ink supply path such that, in this case, the ink supply paths will still act as almost ideal open ends in spite of the increased demand for ink. In this way, the acoustic waves can be prevented from entering into the ink reservoir and from causing cross-talk, regardless of the pixel pattern to be printed, so that the image quality is improved.

The present invention is particularly useful in the case of a printhead design in which the ink supply paths leading from the ink reservoir to the various pressure chambers of one array contain a restricted inlet passage or manifold through which the plurality of ink chambers are commonly connected to the ink reservoir. The acoustic wave attenuator is arranged to attenuate acoustic waves which would otherwise be generated in this passage due to an increase demand for ink and which would then propagate into the neighboring pressure chambers and also into the ink reservoir. By suppressing pressure fluctuations in this inlet passage, the ink supply paths are all allowed to behave like open ends, and intra-array cross-talk, i. e., cross-talk among the pressure chambers belonging to the same array, can be substantially avoided.

In addition, in the case of a multi-array printhead, where the pressure chambers of at least two nozzle arrays are connected to the same ink reservoir, the present invention has the further remarkable advantage that inter-array cross-talk, i. e., cross-talk between the different arrays, can also be suppressed successfully. Such inter-array cross-talk would otherwise be likely to occur, for example, in a hot-melt printhead in which an ink reservoir that is kept at atmospheric pressure and is filled with molten ink to a certain level is disposed above the pressure chambers and is connected to the pressure chambers of each array through respective inlet passages. If the pressure fluctuations in the inlet passages are not attenuated, then a pressure wave would propagate from one of the inlet passages, in which a large demand for ink occurs, into the ink reservoir, and would then be reflected at the liquid/air meniscus in the ink reservoir and would propagate into the inlet passages of the other arrays, where it would give rise to cross-talk. Thanks to the acoustic wave attenuator according to the present invention, this phenomenon can be successfully suppressed.

In a preferred embodiment of the present invention, the acoustic wave attenuator is formed by a compliance element provided in each of the fluid supply paths. Preferably, the compliance element is provided in an inlet passage which forms a common part of the fluid supply paths of the same array. The compliance element may for example be formed by a flexible sheet defining a portion of the wall of the ink supply passage which is allowed to deflect in response to changes in the pressure of the liquid ink, thereby attenuating pressure fluctuations.

In a frequently used printhead design, the pressure chambers are formed by an array of parallel ink channels that are covered by a common flexible sheet, and the actuators are formed as electromechanical actuators arranged to deflect the portions of the flexible sheet covering the various ink channels. Then, a sufficiently large portion of the same flexible sheet, which portion is not rigidly connected to the actuators, may serve as the acoustic wave attenuator according to the present invention. In this way, the invention may be realized with only a minor change in the conventional printhead design. The portion of the flexible sheet serving as the compliance element of the attenuator may comprise a bulge that is lifted off from the surface of the actuator to some extent, so that it is capable of being deflected not only away from the actuator in order to absorb negative pressure waves but also to deflect towards the actuator in order to absorb positive pressure waves.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DETAILED DESCRIPTION OF THE INVENTION

Figure 1:
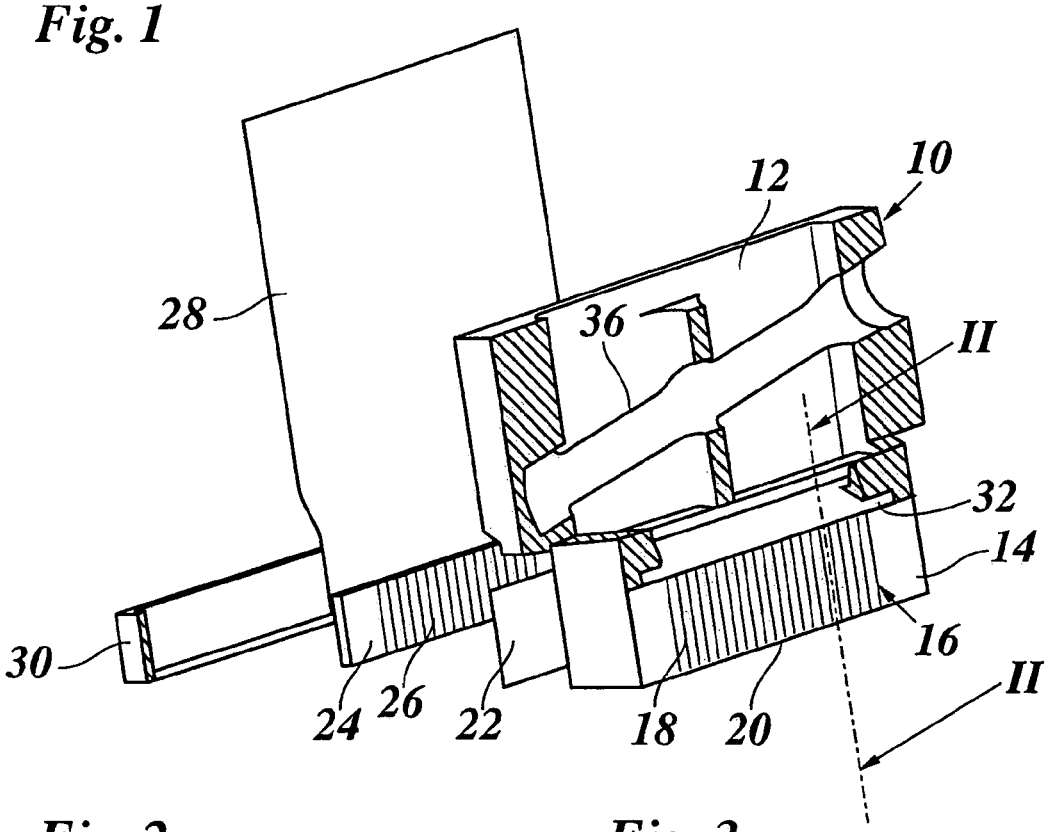
FIG. 1 is an exploded perspective view, partly broken away, of an inkjet printhead according to the present invention.

FIG. 1 shows the essential parts of a hot-melt inkjet printhead which has a symmetric structure and includes a substrate 10 made of graphite, for example, which defines an upwardly open ink reservoir 12 in its upper part. A lower portion of the substrate 10 is configured as a channel plate 14 which has opposite side surfaces only one of which is visible in FIG. 1. Each of these side surfaces is formed with an array 16 of parallel ink channels 18 which have only been shown schematically in FIG. 1. The ink channels 18 are cut into the surface of the channel plate 14, and the lower ends thereof are converged so as to form nozzles 20 through which ink droplets are to be expelled. In this way, a linear array of nozzles 20 is formed on either side of the channel plate 14. The symmetric arrangement of arrays 16 of ink channels 18 and nozzles 20 on both sides of the channel plate 14 can be seen in FIG. 2. Each of the arrays 16 of ink channels 18 is covered by a flexible sheet 22 that is bonded to the ridges of the channel plate 14 separating the individual ink channels 18. Thus, the open outwardly facing sides of all the ink channels 18 and of the nozzles 20 are closed-off by the sheets 22.

An actuator block 24 is bonded to the outer surface of each sheet 22. The actuator block 24 is made of a piezoelectric ceramic material and has a comb-like structure forming a plurality of parallel, vertically extending piezoelectric fingers 26 and is provided with electrodes (not shown) associated with each of the fingers 26. A flexible lead foil 28 is attached to the outer surface of each of the actuator blocks 24 and is formed with electric leads for individually energizing the piezoelectric fingers 26.

The actuator blocks 24 are protected by a cap 30 fitted over the lower end of the channel plate 14 and bonded to the lower edges of the sheets 22 and the lower end face of the channel plate 14.

Figure 2:
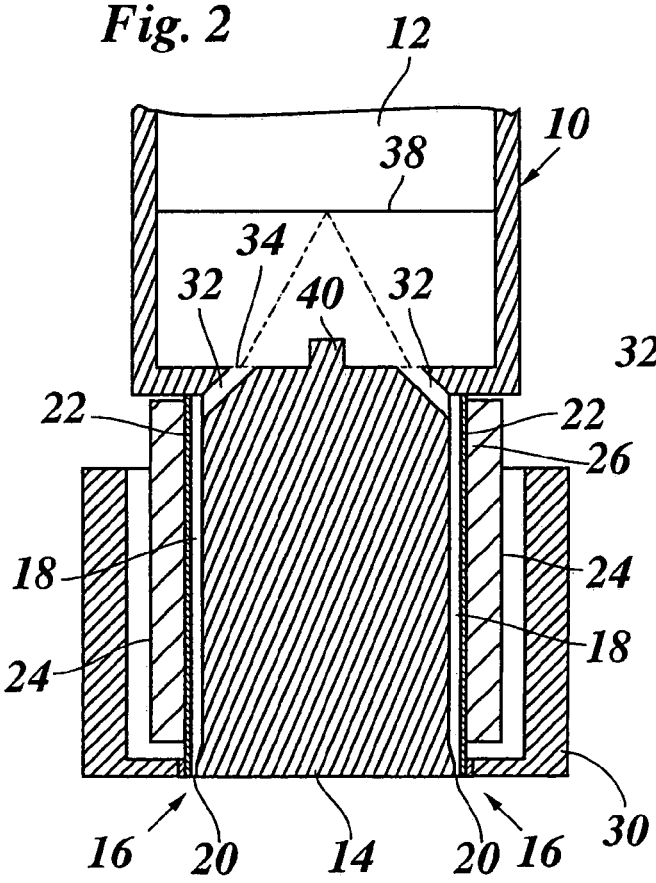
FIG. 2 is a cross-sectional view taken along the line II—II in FIG. 1.

In FIG. 2, the sectional plane passes to the piezoelectric fingers 26 of the actuator blocks 24. It can be seen that these fingers 26 project towards the flexible sheet 22 and each engage a portion of the sheet covering one of the ink channels 18. The top end of the ink channels 18 of each array 16 are connected to the ink reservoir 12 through an inclined inlet passage 32. The top ends of the inlet passages 32, in the plane of the bottom of the ink reservoir 12, may be covered by a filter element 34 which prevents solid particles from entering into the ink channels 18 and clogging the nozzles 20.

As is shown in FIG. 1, a receptacle 36 for accommodating another (coarser) filter element is defined in the walls of the ink reservoir 12. Although not shown in the drawing, the ink reservoir 12 further accommodates a heating element for heating the hot-melt ink so as to maintain the ink in the liquid state. The meniscus of the liquid ink in the ink reservoir 12 is shown at 38 in FIG. 2.

When the printhead is operating, electric signals are supplied to the individual piezoelectric fingers 26 via the lead foil 28, so that the piezoelectric fingers perform expansion and retraction strokes towards and away form the associated ink channel 18, so that the sheet 22 covering this ink channel is flexed, and the liquid ink contained in the ink channel is pressurized and an ink droplet is jetted-out through the nozzle 20. Thus, the ink channels 18 serve as pressure chambers for pressurizing the ink. More precisely, when an ink droplet is to be expelled, the associated piezoelectric finger 26 will at first be retracted, so that ink is sucked-in through the inlet passage 32.

As can be seen in FIG. 1, the ink passage 32 extends transversely of the ink channels 18, and its cross-section is significantly larger than that of the ink channels 18. Thus, when a negative pressure wave propagates in the liquid ink from the ink channel 18 towards the inlet passage 32, the transition between the ink channel and the inlet passage will act like an open end at which the acoustic wave is reflected almost completely, with phase reversal. As a result, a positive pressure wave will then propagate through the ink channel 18 toward the nozzle 20. At appropriate timing, the piezoelectric finger 26 is expanded again, so that the positive pressure wave is boosted. Positive pressure waves propagating towards the inlet passage 32 will also be reflected at the transition, so that no substantial pressure fluctuations should occur in the inlet passage 32.

However, when a plurality adjacent ink channels 18 are energized simultaneously, the demand for ink in the associated portion of the inlet passage 32 may become so large that the ink flow is restricted by the limited cross-section of the inlet passage 32. As a result, the transitions between the ink channels 18 and the ink passage 32 would no longer act as ideal open ends, and the acoustic waves arriving from the ink channels 18 would no longer be reflected completely, but would be partially transmitted through the inlet passage 32 into the ink reservoir 12. A ridge 40 (FIG. 2) formed centrally on the bottom wall of the ink reservoir 12 prevents the direct propagation of the transmitted wave from one inlet passage 32 to the other. However, the pressure waves propagating through the liquid ink in the ink reservoir 12 would be reflected at the meniscus 38 and could then enter into the other inlet passage 32, as is indicated by a dot-dashed line in FIG. 2. If no countermeasures are taken, this propagation of acoustic waves from one inlet passage 32 to the other could give rise to inter-array cross-talk.

Figure 3:
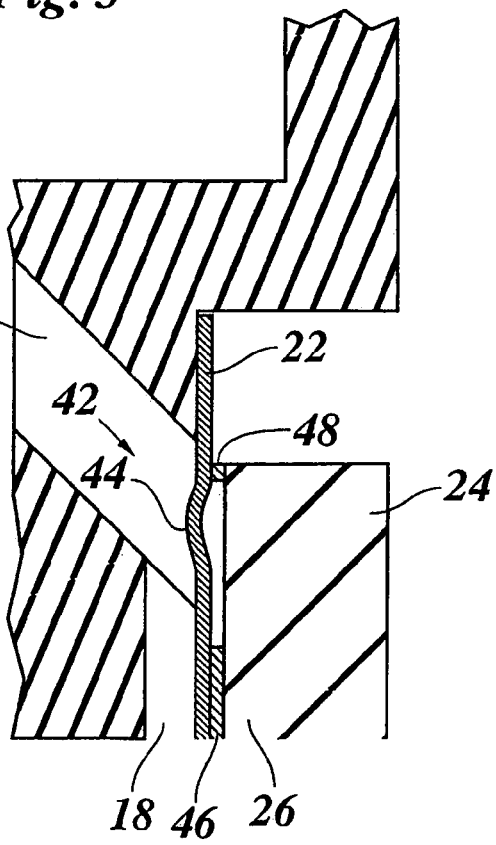
FIG. 3 is an enlarged detail of the sectional view shown in FIG. 2.

In order to avoid this type of cross-talk, the present invention provides an acoustic wave attenuator 42 for controlling the acoustic wave transmission and reflection properties of the ink supply paths connecting the ink reservoir 12 to the ink channels 18 of the two arrays 16. In the present embodiment, as is shown in FIG. 3, such an attenuator 42 is formed by a portion of the flexible sheet 22 which closes off the downstream end of the inlet passage 32 and the top (upstream) end portions of the ink channels 18. In this portion, the sheet 22 is not rigidly connected to the piezoelectric fingers 26 but instead forms a small bulge 44 which slightly projects into the inlet passage 32 and extends transversely of the ink channels 18 throughout the length of the inlet passage 32. Thus, in the bulge 44, the sheet 22 is separated from the piezoelectric finger 26 by a small gap, so that it is free to flex inwardly and outwardly of the inlet passage 32. The rest of the sheet 22 is adhered to the piezoelectric fingers 26 by means of a layer of adhesive 46 which, however, is interrupted in the vicinity of the bulge 44. Only a very small strip of adhesive 48 is applied at the very top end of the actuator block 24. Thus, any pressure waves that might be created in the inlet passage 32 can be attenuated by the flexing movement of the portion of the sheet 22 forming the attenuator 42. This portion of the sheet serves as a compliance element which smoothens out any pressure fluctuations in the inlet passage 32 and assures that the transition between the ink channel 18 and the inlet passage 32 will always act as an open end, with complete reflection of acoustic waves in the ink, even in the case of an increased demand for ink in the inlet passage 32. As a result, no pressure waves will propagate through the inlet passage 32 into the ink reservoir 12 and into the ink passage 32 of the other array, and inter-array cross-talk is eliminated. Similarly the attenuator 42 also helps to reduce cross-talk among adjacent ink passages of the same array.

In a modified embodiment, the length of the actuator block 24 may be reduced so that it covers only the ink channels 18 but not the end of the inlet passage 32. Then, the sheet 22 would freely span the downstream end of the ink passage 32 and would thus be free to act as a compliance element.

In yet another embodiment, the downstream end of the ink supply passage 32 may be closed-off by a rigid member, and the attenuator 42 may be formed in the top ends of the ink channels 18 adjacent to the inlet passage 32. The attenuator 42 may also be formed by other means, for example by a piece of sponge-like material arranged in or close to the inlet passage 32, a trap formed on purpose for capturing an air bubble in the inlet passage 32, and the like.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An Inkjet printhead which comprises:

a common ink reservoir;

a plurality of pressure chambers fluidly connected at one end via a common ink supply path to the common ink reservoir and at the other end to associated nozzles, an actuator operatively associated with each pressure chamber for pressurizing the ink contained therein so as to eject ink droplets through the nozzle in accordance with a print signal, the pressure chambers forming at least one array of parallel-ink channels, said ink supply path for the nozzle channels having an inlet passage which is connected to the ink reservoir and extends transversely of the ink channels for connecting the ink reservoir with the nozzles, and a flexible sheet covering said ink channels with a portion thereof covering said common ink supply path and defining a wall of said path, wherein the printhead is provided with an acoustic wave attenuator which is arranged to control the acoustic reflection and transmission properties of the ink supply path, said wave attenuator being defined by said portion of said flexible sheet which is allowed to flex, relative to the actuators, in response to the pressure fluctuations in the ink supply path, said portion of the sheet forming the wave attenuator being adapted to extend away from the actuators.

2. The printhead according to claim 1, wherein said flexible sheet is a compliant sheet defining a wall of the ink supply path.

3. The printhead according to claim 1, comprising at least two parallel linear arrays of pressure chambers and nozzles, wherein the pressure chambers of said at least two arrays are connected to the same ink reservoir.

4. The printhead according to claim 1, wherein said portion of the sheet forming the attenuator is arranged to close-off a downstream end of the inlet passage.

5. The printhead according to claim 1, wherein said attenuator is formed by a portion of the flexible sheet which closes-off a downstream of the inlet passage and the upstream end portions of the ink channels.

* * * * *